US008847844B2

(12) United States Patent
Kato et al.

(10) Patent No.: US 8,847,844 B2
(45) Date of Patent: Sep. 30, 2014

(54) ANTENNA AND ANTENNA MODULE

(75) Inventors: Noboru Kato, Nagaokakyo (JP); Katsumi Taniguchi, Nagaokakyo (JP); Nobuo Ikemoto, Nagaokakyo (JP); Hiromi Murayama, Nagaokakyo (JP)

(73) Assignee: Murata Manufacturing Co., Ltd., Kyoto (JP)

( * ) Notice: Subject to any disclaimer, the term of this patent is extended or adjusted under 35 U.S.C. 154(b) by 467 days.

(21) Appl. No.: 13/339,544

(22) Filed: Dec. 29, 2011

(65) Prior Publication Data

US 2012/0098729 A1 Apr. 26, 2012

Related U.S. Application Data

(63) Continuation of application No. PCT/JP2010/061230, filed on Jul. 1, 2010.

(30) Foreign Application Priority Data

Jul. 3, 2009 (JP) ..... 2009-158334

(51) Int. Cl.
*H01Q 7/00* (2006.01)
*G08B 13/00* (2006.01)
*H01Q 21/00* (2006.01)

(52) U.S. Cl.
CPC ..... *H01Q 7/00* (2013.01); *G08B 13/00* (2013.01); *H01Q 21/0025* (2013.01)
USPC ..... 343/867; 343/870; 340/572.7

(58) Field of Classification Search
USPC ..... 343/866, 867, 870; 340/572.5, 572.7
See application file for complete search history.

(56) References Cited

U.S. PATENT DOCUMENTS

| | | | | |
|---|---|---|---|---|
| 5,608,417 | A * | 3/1997 | de Vall | 343/895 |
| 2005/0130389 | A1 * | 6/2005 | Yamazaki et al. | 438/455 |
| 2008/0174508 | A1 | 7/2008 | Iwai et al. | |
| 2010/0156750 | A1 | 6/2010 | Ishibashi et al. | |
| 2011/0254752 | A1 | 10/2011 | Kato et al. | |

FOREIGN PATENT DOCUMENTS

| | | | |
|---|---|---|---|
| CN | 101385196 | A | 3/2009 |
| EP | 1085480 | A1 | 3/2001 |
| JP | 10-334203 | A | 12/1998 |
| JP | 2001-84463 | A | 3/2001 |
| JP | 2008-199588 | A | 8/2008 |
| WO | 2009/081719 | A1 | 7/2009 |
| WO | 2011/001709 | A1 | 1/2011 |

OTHER PUBLICATIONS

Official Communication issued in International Patent Application No. PCT/JP2010/061230, mailed on Oct. 12, 2010.

* cited by examiner

*Primary Examiner* — Robert Karacsony
(74) *Attorney, Agent, or Firm* — Keating & Bennett, LLP

(57) ABSTRACT

An antenna includes a flexible sheet, a first coil electrode being formed on a first main surface of the flexible sheet and a second coil electrode being formed on a second main surface of the flexible sheet. Another end portion of the first coil electrode and another end portion 32B of the second coil electrode oppose each other with the flexible sheet there between. One end portion of the first coil electrode opposes an electrode pad, which has a smaller area than the one end portion, with a mounting substrate there between. One end portion of the second coil electrode and a central electrode oppose each other with the flexible sheet there between, and the central electrode opposes an electrode pad, which has a smaller area than the central electrode, with the mounting substrate there between.

10 Claims, 8 Drawing Sheets

ANTENNA AND ANTENNA MODULE

BACKGROUND OF THE INVENTION

1. Field of the Invention

The present invention relates to antennas and antenna modules that are used in communication using electromagnetic field coupling such as RFID communication.

2. Description of the Related Art

Currently, short-range communication systems, in which a variety of non-contact ICs are included, are widely used in a variety of fields. This type of communication system includes a non-contact IC card, which is equipped with, for example, a wireless communication IC, and a card reader, and communication is performed by bringing the non-contact IC card and the card reader within a predetermined distance from each other. An antenna is needed to perform communication and the resonant frequency of this antenna is set on the basis of the frequency of a communication signal. Examples of such an antenna are described in Japanese Unexamined Patent Application Publication No. 2001-84463 and Japanese Unexamined Patent Application Publication No. 10-334203 and these antennas include a coil electrode, which is wound to have a substantially planar shape, and a structure that causes a capacitance to be generated, which, along with the inductance of the coil electrode, is used to set the resonant frequency.

For example, in Japanese Unexamined Patent Application Publication No. 2001-84463, a coil electrode is provided that is wound in a predetermined manner on each of a front surface side and a back surface side of an insulating sheet. These coil electrodes are arranged so as to oppose each other, whereby a desired capacitance is generated. In this case, a large capacitance is obtained by making the width of the coil electrodes large.

In addition, in Japanese Unexamined Patent Application Publication No. 2001-84463, a structure is described in which a coil electrode and one opposing electrode of the capacitor are formed on the front surface side of the insulating sheet and the other opposing electrode of the capacitor is formed on the back surface side of the insulating sheet. In this structure, a conductive through hole is mechanically formed through the insulating sheet in order to connect the back-surface-side opposing electrode and a front-surface-side circuit pattern.

Furthermore, in Japanese Unexamined Patent Application Publication No. 10-334203, a coil electrode is formed on the front surface side of an insulating sheet and a coil electrode and an electrostatic-capacitance-adjusting pattern, which is for causing a capacitance to be generated, are formed on the back surface side of the insulating sheet. Then, the capacitance is adjusted by adjusting the shape (line length) of the electrostatic-capacitance-adjusting pattern.

However, with the structure of Japanese Unexamined Patent Application Publication No. 2001-84463 described above, since the coil electrode is formed to have a small number of turns and a large width, although the capacitance is large, the inductance is very small. Consequently, only a weak magnetic field can be radiated by the antenna and the distance over which communication can be performed is short. This is not suitable for data communication that requires a certain signal level.

Furthermore, in the structure of the related art of Japanese Unexamined Patent Application Publication No. 2001-84463 described above, since the insulating sheet is subjected to mechanical punching in order to physically bring the front-surface-side electrode pattern and the back-surface-side electrode pattern into conductive contact with each other, the manufacturing process is complex.

In addition, in the structure of Japanese Unexamined Patent Application Publication No. 10-334203 described above, the back-surface-side electrostatic-capacitance-adjusting pattern is formed so as to be wound in the same direction as the front-surface-side coil electrode, when viewed in plan, that is, along the direction of the magnetic field at the surface of the antenna. Therefore, the back-surface-side electrostatic-capacitance-adjusting pattern does not contribute to the inductance of the antenna and the inductance of the antenna only depends on the pattern of the front-surface-side coil electrode. Consequently, an increase in the size of the structure due to, for example, the number of windings of the front-surface-side coil electrode being increased in order to increase the inductance so as to increase the strength of the radiated magnetic field, is unavoidable.

In addition, in the case of such an antenna that includes a coil electrode, the characteristics of the antenna are determined by the inductance and capacitance of the coil electrode, which are determined by the pattern of the coil electrode. However, it is not a simple matter to design the antenna so that the inductance and the capacitance of the antenna come to have predetermined values.

SUMMARY OF THE INVENTION

In view of these various issues, preferred embodiments of the present invention provide an antenna with which a predetermined magnetic field strength is obtained, that is simple and compact, and for which designing of the characteristics thereof is simple. In addition, other preferred embodiments of the present invention provide an antenna module that includes antenna and has excellent communication characteristics.

An antenna according to a preferred embodiment of the present invention includes a first coil electrode and a second coil electrode that are arranged so as to oppose each other with a predetermined gap therebetween. The first coil electrode preferably has a planar coil shape and includes a first end portion and a second end portion. The second coil electrode is spaced apart from the first coil electrode by a predetermined distance, preferably has a planar coil shape, and includes a third end portion and a fourth end portion.

In addition, this antenna includes a first connection electrode and a second connection electrode arranged to allow the second end portion of the first coil electrode and the fourth end portion of the second coil electrode to be connected to an external device. This antenna includes a central electrode that is arranged between the fourth end portion and the second connection electrode.

In this antenna, the first coil electrode, the second coil electrode, the first connection electrode, the second connection electrode and the central electrode preferably have predetermined shapes such that the first end portion and the third end portion are capacitively coupled, the second end portion and the first connection electrode are capacitively coupled, the fourth end portion and the central electrode are capacitively coupled, and the central electrode and the second connection electrode are capacitively coupled. In addition, in this antenna, the coupling capacitance between the first end portion and the third end portion is larger than the coupling capacitance between the second end portion and the first connection electrode. Furthermore, in this antenna, the coupling capacitance between the fourth end portion and the central electrode is larger than the coupling capacitance between the central electrode and the second connection electrode.

With this configuration, the capacitance of the antenna is more greatly affected by the coupling capacitance between the second end portion and the first connection electrode and the coupling capacitance between the central electrode and the second connection electrode, than by the coupling capacitance between the first end portion and the third end portion and the coupling capacitance between the fourth end portion and the central electrode. Therefore, by accurately forming and arranging the portion at which the first connection electrode and the second end portion are capacitively coupled with each other and the portion at which the second connection electrode and the central electrode are capacitively coupled with each other, which are structures for allowing connection to an external device, a degree of freedom can be provided to the structures of other components of the antenna. Thus, an antenna can be provided that has a simple design and stable characteristics.

In addition, in an antenna according to a preferred embodiment of the present invention, the first coil electrode and the second coil electrode preferably have coil shapes in which, except for at end portions thereof, the electrodes are substantially not superposed with each other in a direction perpendicular or substantially perpendicular to a plane thereof.

With this configuration, the first coil electrode and the second coil electrode can be caused to be capacitively coupled with each other mainly at the respective end portions thereof.

In addition, in an antenna according to a preferred embodiment of the present invention, the first coil electrode can be located on a first main surface of an insulating substrate having a predetermined thickness. The second coil electrode can be located on a second main surface of the insulating substrate, the second main surface opposing the first main surface.

With this configuration, the specific structures of the first coil electrode and the second coil electrode are provided. Thus, by arranging the first coil electrode and the second coil electrode so as to oppose respective main surfaces of the insulating substrate, the above-described structure can be easily realized.

In addition, in an antenna according to a preferred embodiment of the present invention, the central electrode can be located on the first main surface.

With this configuration, the specific structure of the central electrode is described. Thus, if the first coil electrode and the central electrode are located on the same first main surface, the structure is simplified and it becomes easy to set the coupling capacitances between the first coil electrode and the second coil electrode and the first connection electrode and the second connection electrode.

In addition, in an antenna according to a preferred embodiment of the present invention, the first connection electrode and the second connection electrode and the second end portion and the central electrode may be arranged so as to oppose each other with an insulating external-device-mounting substrate therebetween.

With this configuration, a specific structure is described that provides the positional relationship between the first connection electrode and the second connection electrode and the second end portion and the central electrode.

In addition, in an antenna according to a preferred embodiment of the present invention, at least one of a coupling electrode that opposes the first connection electrode and the second end portion and a coupling electrode that opposes the second connection electrode and the central electrode may be located on a surface of the external-device-mounting substrate on the side of the second end portion and the central electrode.

With this configuration, by utilizing coupling electrodes, coupling capacitances, which are generated by arranging the first connection electrode and the second connection electrode as constituent elements, can be realized more reliably than by directly mounting an external device on the insulating substrate.

In addition, in an antenna according to a preferred embodiment of the present invention, the first connection electrode and the second connection electrode may be located on the same surface as the first coil electrode. In this antenna, the first connection electrode and the second end portion may be arranged on the same surface with a predetermined gap therebetween such that there is a predetermined coupling capacitance due to electromagnetic field coupling. In this antenna, the second connection electrode and the central electrode may be arranged on the same surface with a predetermined gap therebetween such that there is a predetermined coupling capacitance due to electromagnetic field coupling.

With this configuration, a case is illustrated in which the first connection electrode and the second connection electrode are located on the same surface as the first coil electrode. Also with this configuration, the same functional effect is obtained as in the above-described case in which an external-device-mounting substrate is used. Furthermore, with this configuration, there is no need for use of an external-device-mounting substrate and a simpler configuration can be realized.

In addition, in an antenna according to a preferred embodiment of the present invention, the first connection electrode, the second connection electrode, the second end portion of the first coil electrode and the central electrode may have shapes such that at least one of a condition that the first connection electrode has a smaller area than that of the second end portion and a condition that the second connection electrode has a smaller area than that of the central electrode is satisfied.

With this configuration, the above-described relationship between the coupling capacitances and the structure for more specifically realizing this are described. Thus, the areas of the first connection electrode and the second connection electrode are made small, whereby the coupling capacitances obtained by arranging the first connection electrode and the second connection electrode as constituent elements can be easily made small.

In addition, other preferred embodiments of the present invention relate to an antenna module that includes a wireless communication IC device. The antenna module includes a first coil electrode and a second coil electrode. The first coil electrode preferably has a planar coil shape and includes a first end portion and a second end portion. The second coil electrode is spaced apart from the first coil electrode by a predetermined distance, preferably has a planar coil shape, and includes a third end portion and a fourth end portion. In addition, this antenna module includes a first connection electrode and a second connection electrode arranged to allow the second end portion of the first coil electrode and the fourth end portion of the second coil electrode to be connected to the wireless communication IC device. This antenna module includes a central electrode that is arranged between the fourth end portion and the second connection electrode. In this antenna module, the first coil electrode, the second coil electrode, the first connection electrode, the second connection electrode and the central electrode preferably have predetermined shapes such that the first end portion and the third end portion are capacitively coupled, the second end portion and the first connection electrode are capacitively coupled, the fourth end portion and the central electrode are capacitively coupled, and the central electrode and the second connection electrode are capacitively coupled. In addition, in this antenna module, the coupling capacitance between the first end portion and the third end portion is larger than the coupling capacitance between the second end portion and the first connection electrode. Furthermore, in this antenna module, the coupling capacitance between the fourth end portion and the central electrode is larger than the coupling capacitance between the central electrode and the second connection electrode.

With this configuration, description has been given of an antenna module that includes the above-described antenna structure and in which a wireless communication IC is mounted.

In addition, preferred embodiments of the present invention relate to an antenna module that includes a wireless communication IC device. The wireless communication IC device includes a first mounting land electrode and a second mounting land electrode. In addition, the antenna module includes a first coil electrode and a second coil electrode. The first coil electrode preferably has a planar coil shape and includes a first end portion and a second end portion. The second coil electrode is spaced apart from the first coil electrode by a predetermined distance, preferably has a planar coil shape, and includes a third end portion and a fourth end portion. In addition, this antenna module includes a central electrode that is arranged between the fourth end portion and the second mounting land electrode. In the antenna module, the first coil electrode, the second coil electrode and the central electrode preferably have predetermined shapes and the wireless communication IC device is arranged with respect to the first coil electrode and the second coil electrode such that the first end portion and the third end portion are capacitively coupled, the second end portion and the first mounting land electrode are capacitively coupled, the fourth end portion and the central electrode are capacitively coupled and the central electrode and the second mounting land electrode are capacitively coupled. In addition, in this antenna module, the coupling capacitance between the first end portion and the third end portion is larger than the coupling capacitance between the second end portion and the first mounting land electrode. In addition, in this antenna module, the coupling capacitance between the fourth end portion and the central electrode is larger than the coupling capacitance between the central electrode and the second mounting land electrode.

With this configuration, description has been made of a configuration in a case where the above-described first connection electrode and second connection electrode are not included and the first mounting land electrode and the second mounting land electrode for the wireless communication IC are used instead of the first connection electrode and the second connection electrode. Also with this configuration, an antenna module having stable characteristics is realized.

According to various preferred embodiments of the present invention, an antenna is provided that generates a stronger magnetic field than in the related art, is simple and compact and for which the designing of characteristics thereof is simple. In addition, an antenna module is provided that includes the antenna and has excellent communication characteristics.

The above and other elements, features, steps, characteristics and advantages of the present invention will become more apparent from the following detailed description of the preferred embodiments with reference to the attached drawings.

DETAILED DESCRIPTION OF THE PREFERRED EMBODIMENTS

An antenna and an antenna module according to a first preferred embodiment of the present invention will now be described with reference to the drawings.

Figure 1:
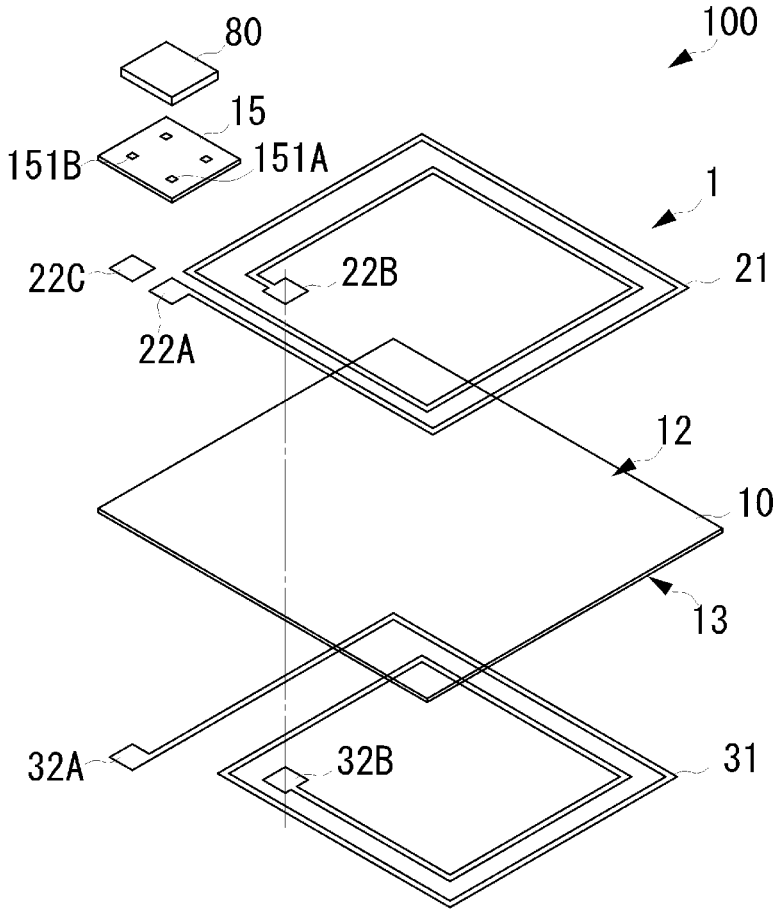
FIG. 1 is an exploded perspective view illustrating the configuration of an antenna module 100 according to a first preferred embodiment of the present invention.
Figure 2A:
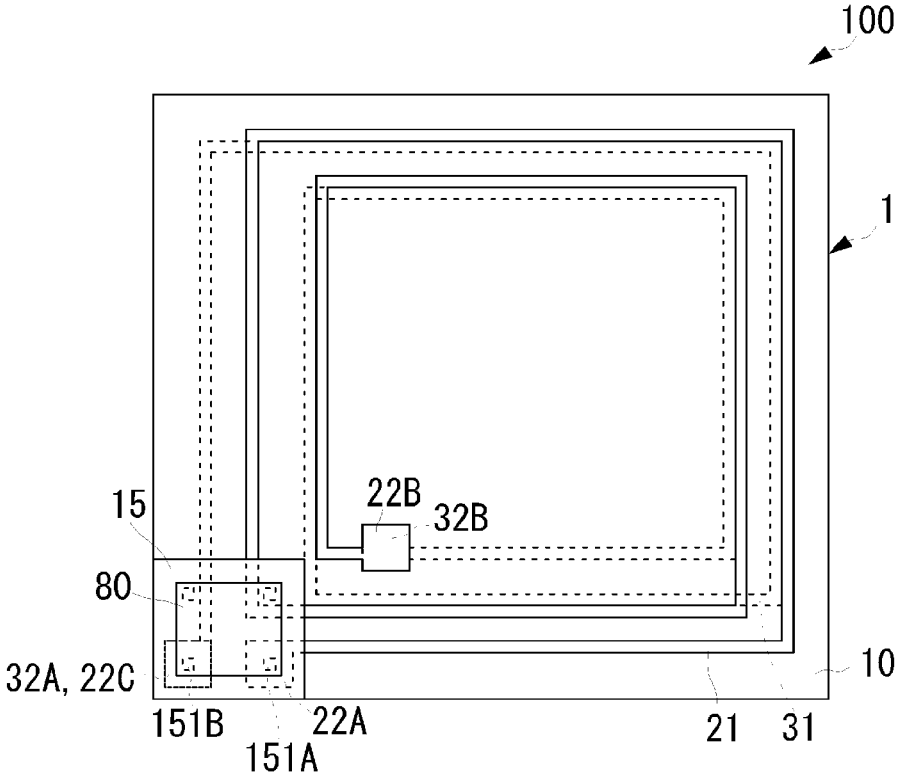
FIGS. 2A and 2B are a plan view and a side view of the antenna module 100 according to the first preferred embodiment of the present invention.
Figure 2B:
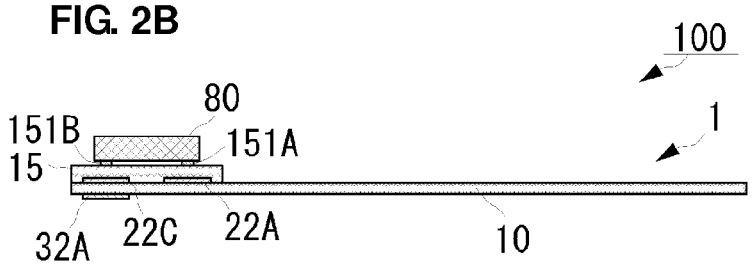

FIG. 1 is an exploded perspective view illustrating the configuration of an antenna module 100 according to this preferred embodiment. FIG. 2A is a plan view seen from a first main surface 12 side of the antenna module 100 and FIG. 2B is a side view of the antenna module 100.

The antenna module 100 includes an antenna 1 and a wireless communication IC 80. The antenna 1 includes a thin-film flexible sheet 10, which is a flat board preferably made of an insulating material such as a resin, and a mounting substrate 15 for the wireless communication IC 80.

A first coil electrode 21 is located on the first main surface 12 of the flexible sheet 10 and a second coil electrode 31 is located on a second main surface 13, which opposes the first main surface 12, of the flexible sheet 10. The first coil electrode 21 and the second coil electrode 31 preferably are line-shaped electrodes, which are preferably made of a metal thin film or the like preferably having a coil shape, and are attached to the flexible sheet 10 with an adhesive or the like.

The first coil electrode 21 includes one end portion 22A at the outermost periphery thereof (corresponding to a "second end portion" according to a preferred embodiment of the present invention) and another end portion 22B at the innermost periphery thereof (corresponding to a "first end portion" according to a preferred embodiment of the present invention). The first coil electrode 21 has a structure in which a line-shaped electrode continuously extends from the one end portion 22A at the outermost periphery to the other end portion 22B at the innermost periphery by being wound sequentially counterclockwise toward the inner peripheral side, when the flexible sheet 10 is viewed from the first main surface 12 side.

The second coil electrode 31 includes one end portion 32A at the outermost periphery thereof (corresponding to a "fourth end portion" according to a preferred embodiment of the present invention) and another end portion 32B at the innermost periphery thereof (corresponding to a "third end portion" according to a preferred embodiment of the present invention.). The second coil electrode 31 has a structure in which a line-shaped electrode continuously extends from the other end portion 32B at the innermost periphery to the one end portion 32A at the outermost periphery by being sequentially wound clockwise toward the outer peripheral side, when the flexible sheet 10 is viewed from the second main surface 13 side. In other words, the second coil electrode 31 has a shape in which it is wound in the opposite direction to the first coil electrode 21.

Then, with this configuration, the first coil electrode 21 and the second coil electrode 31 have a shape in which they are continuously wound in the same direction when the second main surface 13 is viewed from the same direction, for example, from the first main surface 12. Thus, the directions in which currents flow through the first coil electrode 21 and the second coil electrode 31 are the same and the direction of the magnetic field generated by the first coil electrode 21 and the direction of the magnetic field generated by the second coil electrode 31 are the same. As a result, these magnetic fields act so as to be added together and the magnetic field, serving as the antenna (magnetic field whose axis extends in a direction perpendicular or substantially perpendicular to the main surface) becomes stronger. In other words, the first coil electrode 21 and the second coil electrode 31 function as a single coil whose winding direction does not change midway therealong, is continuous and has a greater number of turns.

In this case, without carrying out mechanical connection processing such as forming holes in the flexible sheet 10, by simply forming end portions of the first coil electrode 21 and the second coil electrode 31 so that they oppose each other, the first coil electrode 21 and the second coil electrode 31 can be connected in an alternating manner and therefore a resonance type antenna can be formed by using a simple method and so as to have a simple structure.

The number of turns of the first coil electrode 21 and a length from a position in the center of the plane of the first coil electrode 21 to the group of electrodes are set on the basis of the inductance L21 (refer to FIG. 3), which is to be realized using the first coil electrode 21. Furthermore, the number of turns of the second coil electrode 31 and a length from a position in the center of the plane of the second coil electrode 31 to the group of electrodes are set on the basis of the inductance L31 (refer to FIG. 3), which is to be realized using the second coil electrode 31.

The outermost peripheral end portion 22A and the innermost peripheral end portion 22B of the first coil electrode 21 preferably have a substantially square shape having a width that is larger than that of the wound line-shaped electrode portion. The outermost peripheral end portion 32A and the innermost peripheral end portion 32B of the second coil electrode 31 also have a substantially square shape having a width that is larger than that of the wound line-shaped electrode portions.

The first coil electrode 21 and the second coil electrode 31 have shapes in which the innermost peripheral end portions 22B and 32B are superposed with each other in plan view. In this way, the first coil electrode 21 and the second coil electrode 31 are connected to each other in an alternating manner. In addition, a capacitor can be provided that has a large opposing area and a comparatively large value of capacitance C23B (refer to FIG. 3) in accordance with the opposing area of the other end portions 22B and 32B and the thickness and dielectric constant of the flexible sheet 10.

The first coil electrode 21 and the second coil electrode 31, as illustrated in FIG. 2A, preferably have shapes such that, except for at the innermost peripheral end portions thereof, the coil electrodes are almost entirely not superposed with each other along line-shaped electrode portions thereof.

A substantially square-shaped central electrode 22C is disposed on the first main surface of the flexible sheet at a position that is separated from the outermost peripheral end portion 22A of the first coil electrode 21 by a predetermined distance. Specifically, the central electrode 22C is disposed so as to be superposed with the outermost peripheral end portion 32A of the second coil electrode 31 in plan view. The central electrode 22C also preferably has substantially the same area as the outermost peripheral end portions 22A and 32A and the innermost peripheral end portions 22B and 32B. In this way, a capacitor preferably includes the outermost peripheral end portion 32A of the second coil electrode 31, the central electrode 22C and the flexible sheet 10, the capacitor having a large opposing area and a comparatively large capacitance C23A.

The mounting substrate 15 includes an insulator layer that is substantially square-shaped when viewed in plan and preferably includes an area that encompasses the outermost peripheral end portion 22A of the first coil electrode 21 and the central electrode 22C and in which the wireless communication IC 80 can be mounted.

A plurality of electrode pads (for example, four in FIG. 1 and FIGS. 2A and 2B) including electrode pads 151A (corresponding to a "first connection electrode" according to a preferred embodiment of the present invention) and 151B (corresponding to a "second connection electrode" according to a preferred embodiment of the present invention) are formed on one surface of the mounting substrate 15. The wireless communication IC 80 is mounted using these electrode pads. The electrode pads 151A and 151B have an area that is substantially the same as that of mounting lands that are located on the wireless communication IC 80. The arrangement interval of the electrode pads 151A and 151B is substantially the same as the arrangement interval of the outermost peripheral end portion 22A and the central electrode 22C.

The mounting substrate 15 is disposed on the first main surface 12 side of the flexible sheet 10 such that the electrode pad 151A is superposed with the outermost peripheral end portion 22A and the electrode pad 151B is superposed with the central electrode 22C. At this time, the mounting substrate 15 is attached to the flexible sheet 10 by using, for example, an insulating adhesive agent or adhesive sheet. With this configuration, a capacitor is preferably defined by the electrode pad 151A, the outermost peripheral end portion 22A and the mounting substrate 15, the capacitor having a small opposing area and a small capacitance C25A. In addition, a capacitor is preferably defined by the electrode pad 151B, the central electrode 22C and the mounting substrate 15, the capacitor having a small opposing area and a small capacitance C25B.

Figure 3:
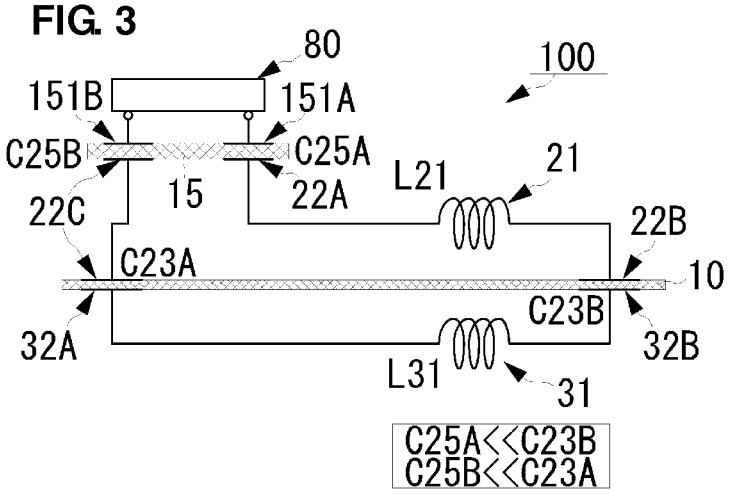
FIG. 3 illustrates the antenna module 100 according to the first preferred embodiment of the present invention as an equivalent circuit seen from the side.

With this configuration, the antenna module 100 of the present preferred embodiment has the circuit configuration illustrated in FIG. 3. FIG. 3 illustrates the antenna module 100 of the present preferred embodiment as an equivalent circuit seen from the side.

As illustrated in FIG. 3, a capacitor (capacitance C25A) defined by the electrode pad 151A and the outermost peripheral end portion 22A, an inductor (inductance L21) defined by the first coil electrode 21 and a capacitor (capacitance C23B) defined by the innermost peripheral end portions 22B and 32B, are connected in series with one another between one terminal of the wireless communication IC 80 on the electrode pad 151A side and an inductor (inductance L31) defined by the second coil electrode 31.

Here, the capacitance C25A defined by the electrode pad 151A and the outermost peripheral end portion 22A is smaller than the capacitance C23B defined by the innermost peripheral end portions 22B and 32B. Therefore, the combined capacitance obtained using the formula to combine capacitances connected in series is strongly affected by the small capacitance C25A but is weakly affected by the large capacitance C23B. Therefore, provided that the capacitance C25A is stable, the combined capacitance is stable even if the capacitance C23B varies.

In addition, a capacitor (capacitance C25B) defined by the electrode pad 151B and the central electrode 22C and a capacitor (capacitance C23A) defined by the central electrode 22C and the outermost peripheral end portion 32A are connected in series with each other between another terminal of the wireless communication IC 80 on the electrode pad 151B side and the inductor (inductance L31) defined by the second coil electrode 31.

Here, the capacitance C25B defined by the electrode pad 151B and the central electrode 22C is smaller than the capacitance C23A defined by the central electrode 22C and the outermost peripheral end portion 32A. Therefore, the combined capacitance obtained using the formula to combine capacitances connected in series is strongly affected by the small capacitance C25B but is weakly affected by the large capacitance C23A. Therefore, provided that the capacitance C25B is stable, the combined capacitance is stable even if the capacitance C23A varies.

Thus, with the configuration of this preferred embodiment, the capacitance of the resonant circuit is substantially determined by the capacitance C25A defined by the electrode pad 151A and the outermost peripheral end portion 22A and the capacitance C25B defined by the electrode pad 151B and the central electrode 22C arranged on the both surfaces of the mounting substrate 15.

Here, the electrode pads 151A and 151B have smaller areas than the outermost peripheral end portion 22A and the central electrode 22C, in other words, the outermost peripheral end portion 22A and the central electrode 22C have larger areas than the electrode pads 151A and 151B, and therefore when the mounting substrate 15 is arranged on the flexible sheet 10, the electrode pads 151A and 151B and the outermost peripheral end portion 22A and the central electrode 22C can be arranged so as to oppose each other with high certainty even if there are some variations in position. Thus, the capacitances C25A and C25B, which depend on the electrode pads 151A and 151B, do not vary.

Therefore, even if there are variations in formation of the antenna 1, the capacitances C25A and C25B will not vary and therefore the resonant frequency of the resonant circuit of the antenna 1 is negligibly affected. Therefore, with this antenna structure, an antenna module having stable communication characteristics is provided.

In addition, in the configuration of this preferred embodiment, the wireless communication IC 80 is mounted on the electrode pads 151A and 151B, which have a small area, of the mounting substrate 15 and therefore the accuracy and speed with which the wireless communication IC 80 is mounted can be improved. Thus, the manufacturing yield and the manufacturing speed for the antenna module 100 can also be improved.

In the above description, the capacitances C25A and C25B were only described as being smaller than the capacitances C23A and C23B, but specifically the capacitances C23A and C23B are on the order of about 100 pF, for example, and the capacitances C25A and C25B are on the order of about 20 pF, for example.

If the capacitances are set in this way and the above-described configuration and manufacturing method are used, high accuracy can be realized comparatively easily and the capacitances C25A and C25B can be realized within a range of about 20 pF±1.0% to 2.0%, for example.

The characteristics of the antenna can be set to be within a range of variability of, for example, about 13.56 MHz±200 kHz by setting the capacitances in the above-described way.

Thus, by using the configuration of this preferred embodiment, an antenna that has desired high-accuracy characteristics can be easily realized.

The set values of these capacitances are examples and the difference between the capacitances C25A and C25B and the capacitances C23A and C23B may be made larger on the basis of the desired characteristics of the antenna.

Furthermore, in the above description, an example was described in which the capacitances C25A and C25B are made small by making the areas of the electrode pads 151A and 151B small, but the capacitances C25A and C25B may be instead made small by changing the material of the mounting substrate 15 or by increasing the thickness of the mounting substrate 15.

Figure 4:
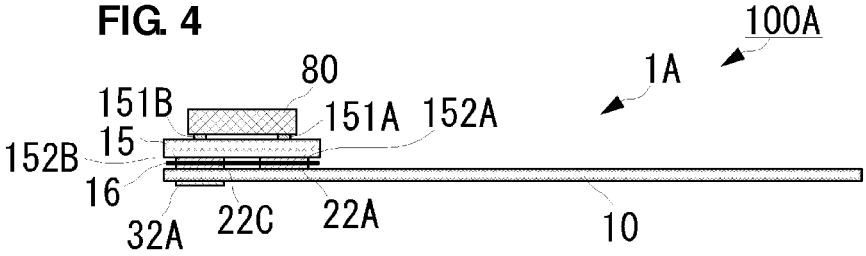
FIG. 4 is a side view of an antenna module 100A according to a second preferred embodiment of the present invention.

Next, an antenna and an antenna module according to a second preferred embodiment according to the present invention will be described with reference to the drawings. FIG. 4 is a side view of an antenna module 100A according to the second preferred embodiment according to the present invention.

The antenna module 100A (antenna 1A), in contrast to the antenna module 100 (antenna 1) described in the first preferred embodiment, has a configuration in which mounting electrodes 152A and 152B are arranged on the flexible sheet 10 side of the mounting substrate 15.

The mounting electrode 152A is preferably arranged so as to be superposed with the electrode pad 151A when viewed in plan and preferably has substantially the same shape as the outermost peripheral end portion 22A. The mounting electrode 152B is preferably arranged so as to be superposed with the electrode pad 151B when viewed in plan and preferably has substantially the same shape as the central electrode 22C.

The mounting substrate 15 is disposed on the flexible sheet 10 such that the mounting electrode 152A and the outermost peripheral end portion 22A are superposed with each other and that the mounting electrode 152B and the central electrode 22C are superposed with each other. The mounting substrate 15 and the flexible sheet 10 are attached to each other using, for example, an insulating adhesive sheet 16.

Figure 5:
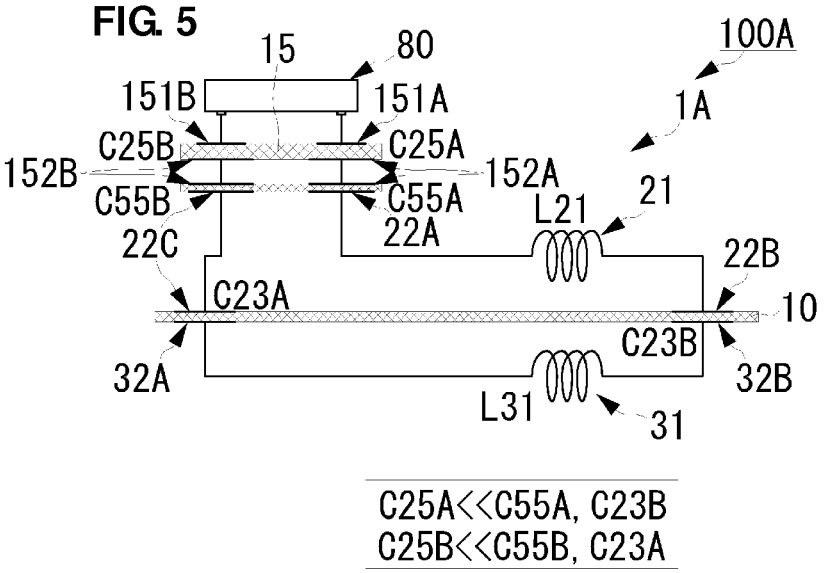
FIG. 5 illustrates the antenna module 100A according to the second preferred embodiment of the present invention as an equivalent circuit seen from the side.

With this configuration, the antenna module 100A of the present preferred embodiment has the circuit configuration illustrated in FIG. 5. FIG. 5 illustrates the antenna module 100A of the present preferred embodiment as an equivalent circuit seen from the side.

As illustrated in FIG. 5, a capacitor (capacitance C25A) defined by the electrode pad 151A and the mounting electrode 152A, a capacitor (capacitance C55A) defined by the mounting electrode 152A and the outermost peripheral end portion 22A, an inductor (inductance L21) defined by the first coil electrode 21 and a capacitor (capacitance C23B) defined by the innermost peripheral end portions 22B and 32B, are connected in series with one another between one terminal of the wireless communication IC 80 on the electrode pad 151A side and an inductor (inductance L31) defined by the second coil electrode 31.

Here, the capacitance C25A defined by the electrode pad 151A and the mounting electrode 152A is smaller than the capacitance C23B defined by the innermost peripheral end portions 22B and 32B. In addition, the capacitance C55A defined by the mounting electrode 152A and the outermost peripheral end portion 22A is a capacitance that is substantially the same as the capacitance C23B. Therefore, the combined capacitance obtained using the formula to combine capacitances connected in series is strongly affected by the small capacitance C25A but is weakly affected by the large capacitances C55A and C23B. Therefore, provided that the capacitance C25A is stable, the combined capacitance will be stable even if the capacitances C55A and C23B vary.

In addition, a capacitor (capacitance C25B) defined by the electrode pad 151B and the mounting electrode 152B, a capacitor (capacitance C55B) defined by the mounting electrode 152B and the central electrode 22C, and a capacitor (capacitance C23A) defined by the central electrode 22C and the outermost peripheral end portion 32A are connected in series with one another between another terminal of the wireless communication IC 80 on the electrode pad 151B side and the inductor (inductance L31) defined by the second coil electrode 31.

Here, the capacitance C25B defined by the electrode pad 151B and the mounting electrode 152B is smaller than the capacitance C23A defined by the central electrode 22C and the outermost peripheral end portion 32A. In addition, the capacitance C55B defined by the mounting electrode 152B and the central electrode 22C is a capacitance that is substantially the same as the capacitance C23A. Therefore, the combined capacitance obtained using the formula to combine capacitances connected in series is strongly affected by the small capacitance C25B but is weakly affected by the large capacitances C55B and C23A. Therefore, provided that the capacitance C25B is stable, the combined capacitance will be stable even if the capacitances C55B and C23A vary.

Thus, with the configuration of this preferred embodiment, the capacitance of the resonant circuit is substantially determined by the capacitance C25A defined by the electrode pad 151A and the mounting electrode 152A and the capacitance C25B defined by the electrode pad 151B and the mounting electrode 152B arranged on the both surfaces of the mounting substrate 15.

Therefore, similarly to the first preferred embodiment, even if there are variations in the formation of the antenna 1A, the capacitances C25A and C25B will not vary and therefore the resonant frequency of the resonant circuit of the antenna 1A and the antenna module 100A will be negligibly affected and an antenna module having stable communication characteristics is provided.

Furthermore, with the configuration of this preferred embodiment, the electrode pads 151A and 151B and the mounting electrodes 152A and 152B are preferably formed at the time of forming the mounting substrate 15 and therefore these electrodes can be arranged to oppose one another with high accuracy. Thus, the capacitances C25A and C25B can be set with high accuracy and the antenna and antenna module can be formed with greater stability. In this preferred embodiment, an example was described in which the mounting electrodes 152A and 152B preferably have substantially the same area as the central electrode 22C and the outermost peripheral end portion 22A, but so long as the mounting electrode 152A and 152B have larger areas than the electrode pads 151A and 151B, the configuration of this preferred embodiment can be adopted. In addition, in this preferred embodiment, an example was described in which two mounting electrodes are arranged to oppose two corresponding electrode pads, but instead only a single mounting electrode that opposes a single electrode pad may be provided.

Figure 6:
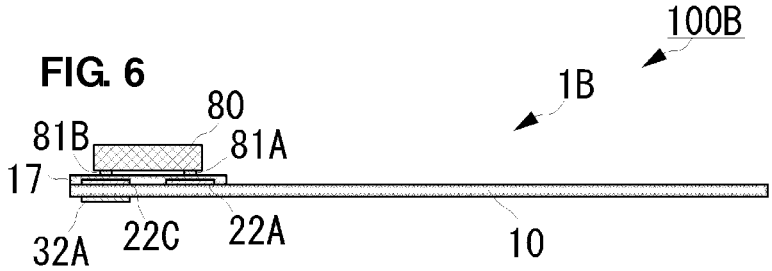
FIG. 6 is a side view of an antenna module 100B according to a third preferred embodiment of the present invention.

Next, an antenna module according to a third preferred embodiment of the present invention will be described with reference to the drawings. FIG. 6 is a side view of an antenna 1B and an antenna module 100B according to this preferred embodiment of the present invention. As illustrated in FIG. 6, in contrast to the antenna 1 and the antenna module 100 described in the first preferred embodiment of the present invention, the mounting substrate 15 is omitted from the antenna 1B and the antenna module 100B of this preferred embodiment of the present invention.

In the antenna module 100B, mounting lands 81A and 81B located on the wireless communication IC 80 are arranged so as to oppose the outermost peripheral end portion 22A and the central electrode 22C with an insulating adhesive layer 17 therebetween.

Also with this configuration, as with the first preferred embodiment, an antenna module can be provided that is not affected by variations in formation of the antenna 1B and has stable communication characteristics.

Figure 7:
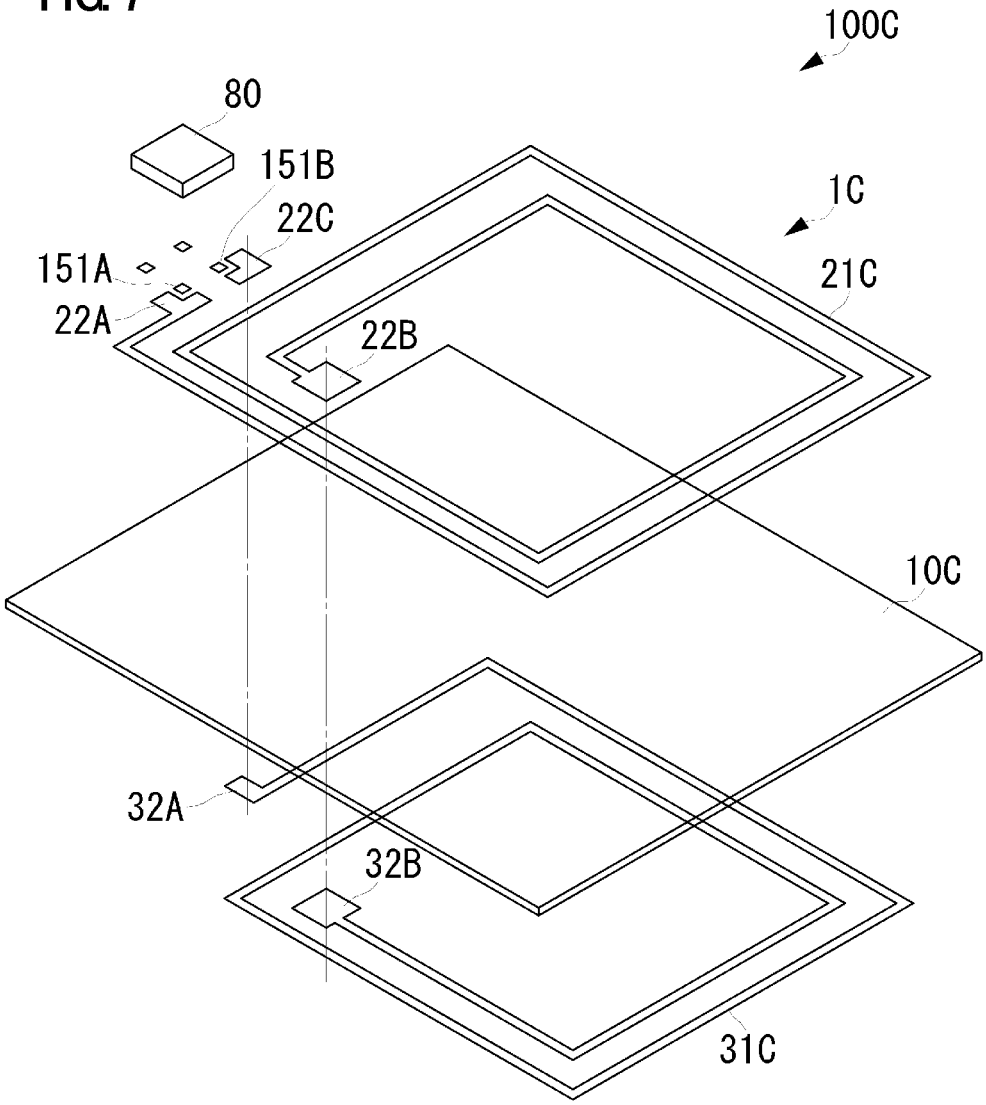
FIG. 7 is an exploded perspective view illustrating the configuration of an antenna module 100C according to a fourth preferred embodiment of the present invention.
Figure 8A:
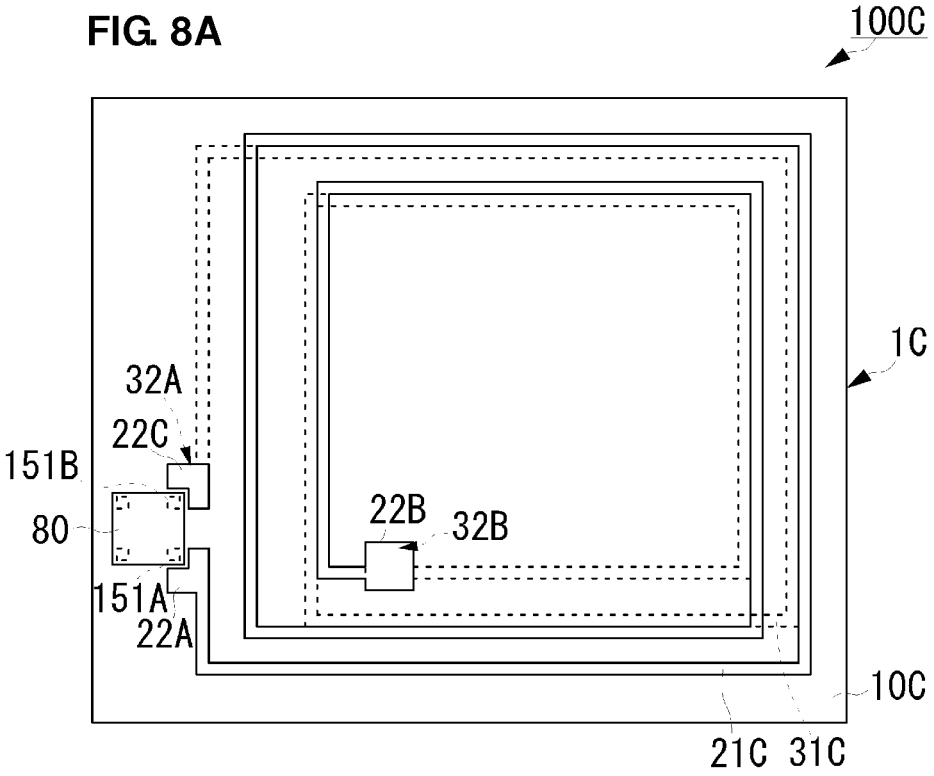
FIGS. 8A and 8B are a plan view and a side view of the antenna module 100C according to the fourth preferred embodiment.
Figure 8B:
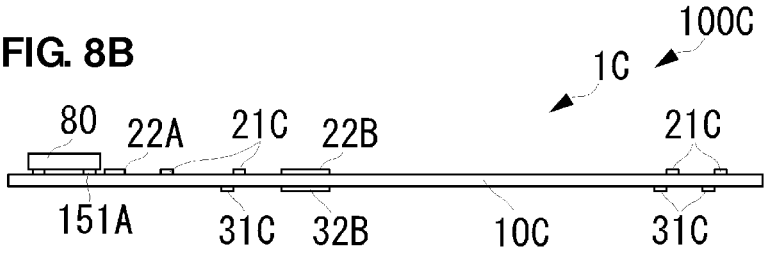

Next, an antenna module according to a fourth preferred embodiment of the present invention will be described with reference to the drawings. FIG. 7 is an exploded perspective view illustrating the configuration of an antenna module 100C according to this preferred embodiment of the present invention. FIG. 8A and FIG. 8B are a plan view and a side view of the antenna module 100C according to this preferred embodiment of the present invention.

The antenna module 100C includes an antenna 1C and the wireless communication IC 80.

The antenna 1C has a structure that preferably is basically the same as that of the antenna 1 described in the first preferred embodiment of the present invention and a first coil electrode 21C preferably has a coil shape on a first main surface of an insulating flexible sheet 10C and a second coil electrode 31C preferably has a coil shape on a second main surface of the flexible sheet 10C. The first coil electrode 21C has a shape in which it is sequentially wound toward the inside in the counterclockwise direction from the outermost peripheral end portion 22A to the innermost peripheral end portion 22B, when viewed from the first main surface side. The second coil electrode 31C has a shape in which it is sequentially wound toward the outside in the clockwise direction from the innermost peripheral end portion 32B to the outermost peripheral end portion 32A, when viewed from the second main surface side.

The outermost peripheral end portion 22A and the innermost peripheral end portion 22B of the first coil electrode 21C have shapes having a width that is larger than that of the wound line-shaped electrode portion. The outermost peripheral end portion 32A and the innermost peripheral end portion 32B of the second coil electrode 31C also have shapes having a width that is larger than that of the wound line-shaped electrode portion.

The first coil electrode 21C and the second coil electrode 31C have shapes such that the innermost peripheral end portions 22B and 32B are superposed with each other in plan view. In this way, a capacitor is defined by the innermost peripheral end portions 22B and 32B of the first coil electrode 21C and the second coil electrode 31C and the flexible sheet 10C, the capacitor having a large opposing area and a comparatively large capacitance.

The first coil electrode 21C and the second coil electrode 31C, as illustrated in FIG. 8A, are arranged so as to have shapes such that, except for at the outermost peripheral end portions and the innermost peripheral end portions thereof, the electrodes are almost entirely not superposed with each other along the line-shaped electrode portions thereof.

The central electrode 22C, which has substantially the same area as the outermost peripheral end portion 22A, is arranged at a position spaced apart from the outermost peripheral end portion 22A of the first coil electrode 21C by a predetermined distance on the first main surface of the flexible sheet 10C. Specifically, the central electrode 22C is disposed so as to be superposed with the outermost peripheral end portion 32A of the second coil electrode 31C in plan view. In this way, a capacitor is defined by the outermost peripheral end portion 32A of the second coil electrode 31C, the central electrode 22C and the flexible sheet 10C, the capacitor having a large opposing area and a comparatively large capacitance.

The electrode pad 151A, which is arranged at a certain distance from the outermost peripheral end portion 22A at which capacitive coupling is possible, is located on the first main surface of the flexible sheet 10C. In addition, the electrode pad 151B, which is arranged at a certain distance from the central electrode 22C at which capacitive coupling is possible, is located on the first main surface of the flexible sheet 10C. In this way, a capacitor having a small capacitance is preferably defined by the outermost peripheral end portion 22A and the electrode pad 151A, which are located on the same surface. In addition, a capacitor having a small capacitance is preferably defined by the central electrode 22C and the electrode pad 151B, which are located on the same surface.

The wireless communication IC 80 is mounted on the flexible sheet 10C via the group of electrode pads, which includes the electrode pads 151A and 151B, arranged in a predetermined pattern.

With such a configuration, capacitive coupling obtained on the same surface is much lower than capacitive coupling between opposing electrodes. Therefore, the capacitance defined by the outermost peripheral end portion 22A and the electrode pad 151A and the capacitance defined by the central electrode 22C and the electrode pad 151B obtained by capacitive coupling on the same surface are much smaller than that of the capacitor formed of the innermost peripheral end portions 22B and 32B and the capacitance defined by the outermost peripheral end portion 32A and the central electrode 22C.

Therefore, the combined capacitance of the resonant circuit is determined by the capacitance defined by the outermost peripheral end portion 22A and the electrode pad 151A and the capacitance defined by the central electrode 22C and the electrode pad 151B. As a result, as with the first, second and third preferred embodiments of the present invention, an antenna module can be provided that is not affected by variations in the formation of the antenna 1C and has stable communication characteristics.

Figure 9:
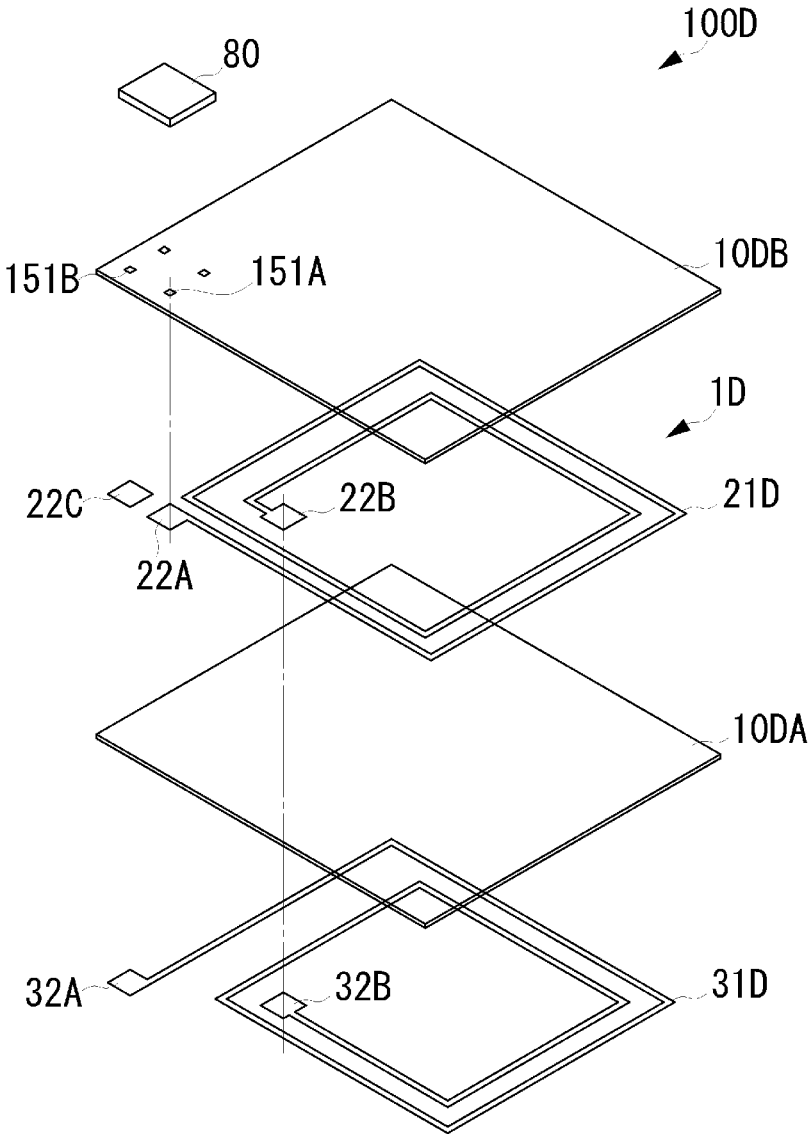
FIG. 9 is an exploded perspective view illustrating the configuration of an antenna module 100D according to a fifth preferred embodiment of the present invention.
Figure 10:
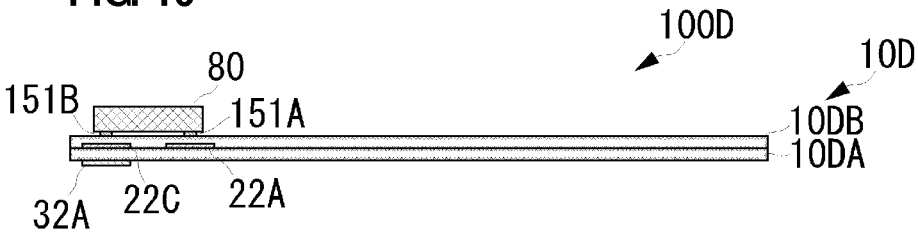
FIG. 10 is a side view of the antenna module 100D according to a fifth preferred embodiment of the present invention.

Next, an antenna and an antenna module according to a fifth preferred embodiment of the present invention will be described with reference to the drawings. FIG. 9 is an exploded perspective view illustrating the configuration of an antenna module 100D according to this preferred embodiment of the present invention. FIG. 10 is a side view of the antenna module 100D according to this preferred embodiment of the present invention. The antenna module 100D according to this preferred embodiment of the present invention preferably does not include the flexible sheet 10 and the mounting substrate 15 of the antenna module 100 described in the first preferred embodiment of the present invention, but instead includes an insulator substrate 10D, which has a configuration in which insulator layers 10DA and 10DB are layered.

The insulator layer 10DA of the antenna module 100D corresponds to the flexible sheet 10 of the antenna module 100 and the insulator layer 10DB of the antenna module 100D corresponds to a layer that forms the mounting substrate 15 of the antenna module 100 with an area substantially the same as that of the flexible sheet 10. Also with this configuration, an antenna module that has stable communication characteristics can be provided.

In the above description, the electrode pads 151A and 151B, which are located on the mounting substrate 15 and the insulator layer 10DB, are preferably used as electrodes to mount the wireless communication IC 80, but, in addition to the electrode pads 151A and 151B, a structure in which electrodes to mount the wireless communication IC 80 are provided and these electrodes are connected to each other with a wiring electrode pattern may be adopted.

Figure 11A:
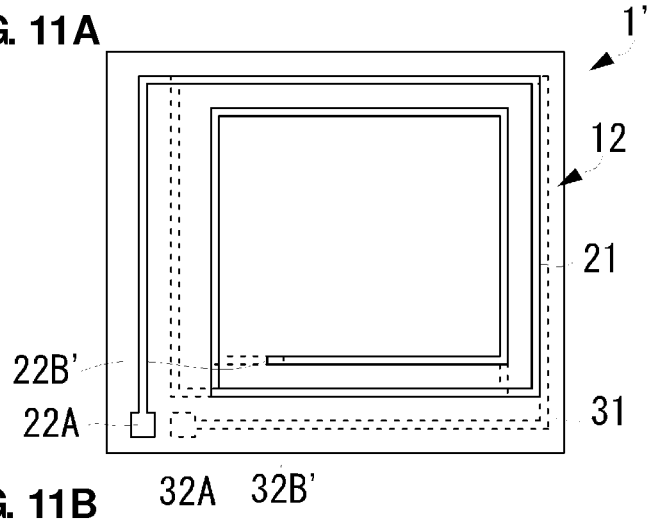
FIGS. 11A and 11B are plan views illustrating another example of formation of a first coil electrode and a second coil electrode.
Figure 11B:
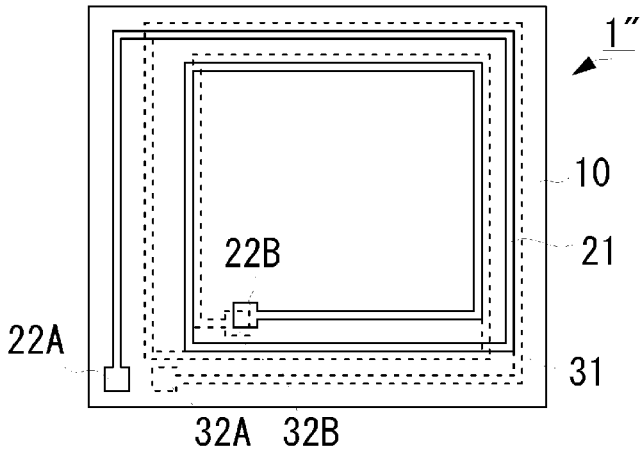

In addition, in the above-described preferred embodiments, cases were described in which the wound line-shaped electrode portions of the first and second coil electrodes including a flexible sheet or insulator layer therebetween almost entirely do not oppose each other, whereas ends of both the first coil electrode and the second coil electrode preferably have a planar shape that is wider than the respective line-shaped portions and oppose each other over substantially the entire areas thereof. However, provided that the above-described predetermined inductances and capacitances are obtained, the structure illustrated in FIGS. 11A and 11B may be adopted. FIGS. 11A and 11B are plan views illustrating another example of formation of a first coil electrode and a second coil electrode. FIG. 11A illustrates a case in which inner peripheral ends of the first coil electrode 21 and the second coil electrode 31 do not have a wide planar shape and substantially oppose the line-shaped electrode as they are. FIG. 11B illustrates a case in which the inner peripheral ends of the first coil electrode 21 and the second coil electrode 31 oppose each other while being shifted from each other by a predetermined amount. The same functional effect as in each of the above-described preferred embodiments can also be obtained with these structures. In addition, although not illustrated, even if a configuration in which both ends of the first coil electrode and the second coil electrode do not have a wide planar shape is adopted, this configuration can be applied to each of the preferred embodiments of the present invention.

Figure 12A:
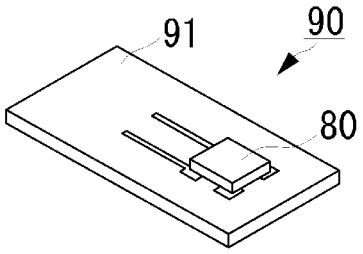
FIGS. 12A and 12B illustrate the configuration of an electromagnetic coupling module 90.
Figure 12B:
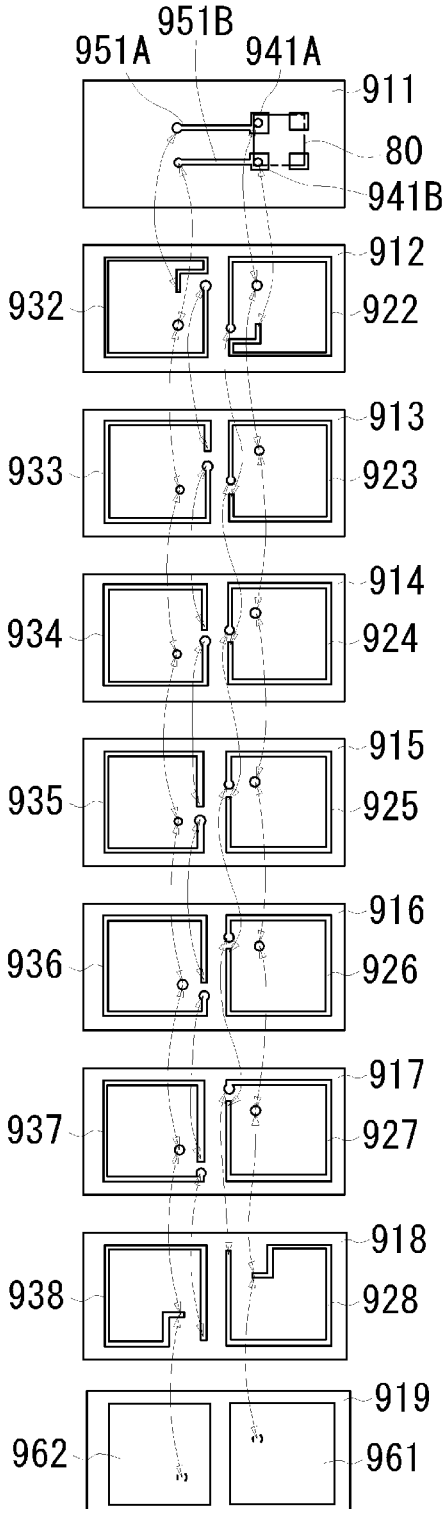

Furthermore, in the above descriptions, an example was described in which a wireless communication IC chip is used as is, but an electromagnetic coupling module such as that illustrated in FIGS. 12A and 12B may be used instead. FIGS. 12A and 12B illustrate a configuration of an electromagnetic coupling module 90, where FIG. 12A illustrates an external perspective view and FIG. 12B illustrates an exploded layered view.

The electromagnetic coupling module 90 includes a power-feeding substrate 91 and the wireless communication IC 80, which is mounted on the power-feeding substrate 91, as illustrated in FIGS. 12A and 12B. The power-feeding substrate 91 preferably includes a multilayer circuit board formed by stacking dielectric layers, on which electrode patterns have been formed on surfaces thereof, on top of one another. For example, as illustrated in FIG. 12B, a structure is preferably used that is preferably formed by stacking, for example, nine dielectric layers 911 to 919 on top of one another. On the dielectric layer 911, which is the uppermost layer, mounting lands 941A and 941B for the wireless communication IC 80 are formed and respective surface electrode patterns 951A and 951B are formed on the mounting lands 941A and 941B. On the second to eighth dielectric layers 912 to 918, respective first C-shaped pattern electrodes 922 to 928 and second C-shaped pattern electrodes 932 to 938 are formed.

The first C-shaped pattern electrodes 922 to 928 are electrically connected to one another by via holes and define a first coil whose axial direction is the stacking direction. The two ends of the first coil are respectively connected to the mounting lands 941A and 941B provided on the dielectric layer 911, which is the uppermost layer, through via holes. In addition, the second C-shaped pattern electrodes 932 to 938 are electrically connected to one another by via holes and define a second coil whose axial direction is the stacking direction. The two ends of the second coil are respectively connected to end portions of the surface electrode patterns 951A and 951B provided on the dielectric layer 911, which is the uppermost layer, through via holes.

Two outer connection electrodes 961 and 962 are located on the dielectric layer 919, which is the lowermost layer. The two outer connection electrodes 961 and 962 are respectively connected to the first C-shaped pattern electrodes 922 to 928 and the second C-shaped pattern electrodes 932 to 938 via through holes. These two outer connection electrodes play the same role as the mounting lands to connect the wireless communication IC to the outside, as described in each of the above-described preferred embodiments.

While preferred embodiments of the present invention have been described above, it is to be understood that variations and modifications will be apparent to those skilled in the art without departing from the scope and spirit of the present invention. The scope of the present invention, therefore, is to be determined solely by the following claims.

What is claimed is:

1. An antenna comprising:

a first coil electrode having a planar coil shape and including a first end portion and a second end portion;

a second coil electrode that is spaced apart from the first coil electrode by a predetermined distance, has a planar coil shape and includes a third end portion and a fourth end portion;

a first connection electrode and a second connection electrode arranged to allow the second end portion of the first coil electrode and the fourth end portion of the second coil electrode to be connected to an external device; and a central electrode that is arranged between the fourth end portion and the second connection electrode; wherein the first coil electrode, the second coil electrode, the first connection electrode, the second connection electrode and the central electrode are arranged such that the first end portion and the third end portion are capacitively coupled, the second end portion and the first connection electrode are capacitively coupled, the fourth end portion and the central electrode are capacitively coupled, and the central electrode and the second connection electrode are capacitively coupled; and a coupling capacitance between the first end portion and the third end portion is larger than a coupling capacitance between the second end portion and the first connection electrode and a coupling capacitance between the fourth end portion and the central electrode is larger than a coupling capacitance between the central electrode and the second connection electrode.

2. The antenna according to claim 1, wherein the first coil electrode and the second coil electrode have coil shapes in which, except for at end portions thereof, are substantially not superposed with each other in a direction perpendicular or substantially perpendicular to a plane thereof.

3. The antenna according to claim 1, wherein the first coil electrode is located on a first main surface of an insulating substrate that has a predetermined thickness, and the second coil electrode is located on a second main surface of the insulating substrate, the second main surface opposing the first main surface.

4. The antenna according to claim 3, wherein the central electrode is located on the first main surface.

5. The antenna according to claim 1, wherein the first connection electrode and the second connection electrode and the second end portion and the central electrode are arranged so as to oppose each other with an insulating external-device-mounting substrate therebetween.

6. The antenna according to claim 5, wherein at least one of a coupling electrode that opposes the first connection electrode and the second end portion and a coupling electrode that opposes the second connection electrode and the central electrode is located on a surface of the external-device-mounting substrate on the second end portion and central electrode side.

7. The antenna according to claim 1, wherein the first connection electrode and the second connection electrode are located on the same surface as the first coil electrode, the first connection electrode and the second end portion are arranged on the same surface with a predetermined gap therebetween such that there is a predetermined coupling capacitance therebetween due to electromagnetic field coupling, and the second connection electrode and the central electrode are arranged on the same surface with a predetermined gap therebetween such that there is a predetermined coupling capacitance therebetween due to electromagnetic field coupling.

8. The antenna according to claim 1, wherein the first connection electrode, the second connection electrode, the second end portion of the first coil electrode and the central electrode are arranged such that at least one of a condition that the first connection electrode has a smaller area than the second end portion and a condition that the second connection electrode has a smaller area than the central electrode is satisfied.

9. An antenna module comprising:

a wireless communication IC device;

a first coil electrode having a planar coil shape and including a first end portion and a second end portion;

a second coil electrode that is spaced apart from the first coil electrode by a predetermined distance, has a planar coil shape and includes a third end portion and a fourth end portion;

a first connection electrode and a second connection electrode arranged to allow the second end portion of the first coil electrode and the fourth end portion of the second coil electrode to be connected to the wireless communication IC device; and a central electrode that is arranged between the fourth end portion and the second connection electrode; wherein the first coil electrode, the second coil electrode, the first connection electrode, the second connection electrode and the central electrode are arranged such that the first end portion and the third end portion are capacitively coupled, the second end portion and the first connection electrode are capacitively coupled, the fourth end portion and the central electrode are capacitively coupled, and the central electrode and the second connection electrode are capacitively coupled; and a coupling capacitance between the first end portion and the third end portion is larger than a coupling capacitance between the second end portion and the first connection electrode, and wherein a coupling capacitance between the fourth end portion and the central electrode is larger than a coupling capacitance between the central electrode and the second connection electrode.

10. An antenna module comprising:

a wireless communication IC device that includes a first mounting land electrode and a second mounting land electrode;

a first coil electrode having a planar coil shape and including a first end portion and a second end portion;

a second coil electrode that is spaced apart from the first coil electrode by a predetermined distance, has a planar coil shape and includes a third end portion and a fourth end portion; and a central electrode that is arranged between the fourth end portion and the second mounting land electrode; wherein the first coil electrode, the second coil electrode and the central electrode and the wireless communication IC device is arranged with respect to the first coil electrode and the second coil electrode such that the first end portion and the third end portion are capacitively coupled, the second end portion and the first mounting land electrode are capacitively coupled, the fourth end portion and the central electrode are capacitively coupled and the central electrode and the second mounting land electrode are capacitively coupled;

a coupling capacitance between the first end portion and the third end portion is larger than a coupling capacitance between the second end portion and the first mounting land electrode; and a coupling capacitance between the fourth end portion and the central electrode is larger than a coupling capacitance between the central electrode and the second mounting land electrode.

* * * * *